US006990898B2

(12) United States Patent
Kato

(10) Patent No.: US 6,990,898 B2
(45) Date of Patent: Jan. 31, 2006

(54) MECHANICAL PRESSING MACHINE

(75) Inventor: Heizaburo Kato, Ogasa-gun (JP)

(73) Assignee: Sankyo Seisakusho Co., Tokyo (JP)

( * ) Notice: Subject to any disclaimer, the term of this patent is extended or adjusted under 35 U.S.C. 154(b) by 64 days.

(21) Appl. No.: 10/848,619

(22) Filed: May 18, 2004

(65) Prior Publication Data

US 2004/0231396 A1 Nov. 25, 2004

(30) Foreign Application Priority Data

May 23, 2003 (JP) ..... 2003-145944

(51) Int. Cl.
*B30B 1/26* (2006.01)

(52) U.S. Cl. ..... 100/282; 100/292; 72/452.6; 83/628; 74/55; 74/603

(58) Field of Classification Search ..... 100/280, 100/282, 291, 292; 72/452.4, 452.6, 452.7; 83/615, 628; 74/53, 54, 55, 56, 589, 590, 74/591, 603, 604
See application file for complete search history.

(56) References Cited

U.S. PATENT DOCUMENTS 2,677,966 A * 5/1954 Mueller ..... 74/55
4,638,731 A * 1/1987 Kato ..... 100/282
5,467,706 A * 11/1995 Kato ..... 100/282
5,544,576 A * 8/1996 Kato ..... 100/35
5,605,096 A * 2/1997 Kato ..... 100/292
5,687,645 A 11/1997 Kato ..... 100/282

FOREIGN PATENT DOCUMENTS

DE 3929382 A1 * 5/1991
JP Y2-5-22394 6/1993
JP Y2-5-22395 6/1993

* cited by examiner

*Primary Examiner*—Derris H. Banks
*Assistant Examiner*—Jimmy T. Nguyen
(74) *Attorney, Agent, or Firm*—Harness, Dickey & Pierce, P.L.C.

(57) ABSTRACT

A mechanical pressing machine includes a slider mounted on an input shaft at a location below a cam, and a sliding block and a balance weight mounted at locations above the cam. A first cam follower rotatably carried on the slider abuts against a lower surface of the cam and is biased by a spring member toward the lower surface. A second cam follower rotatably carried on a sliding block abuts against an upper surface of the cam and is biased by spring members toward the upper surface. When the cam is rotated together with the input shaft, the slider effects vertical sliding movement through the first cam follower, and the sliding block and the balance weight effect vertical sliding movement in a direction opposite from the direction of movement of the slider through the second cam follower.

8 Claims, 5 Drawing Sheets

MECHANICAL PRESSING MACHINE

BACKGROUND OF THE INVENTION

1. Field of the Invention

The present invention relates to a mechanical pressing machine so designed that a slider is reciprocally moved utilizing a cam mechanism.

2. Description of the Related Art

Mechanical pressing machines for producing by press working small-sized electronic components or the like at a high speed and with a high accuracy have been conventionally known. One type of such pressing machines includes a horizontal input shaft rotatably mounted in a housing, a cam mounted concentrically on the input shaft, and a slider mounted in the housing for vertical sliding movement and surrounding the cam. The slider has a die fixed to its lower end and carries a cam follower which is always in engagement with the cam, so that when the cam is rotated together with the input shaft the slider effects vertical sliding movement. The pressing machine of such type is disclosed in JP-Y2-5-22394 and JP-Y2-22395, for example.

In mechanical pressing machines utilizing a cam mechanism, it has been conventionally known to incorporate therein a dynamic balancer. The dynamic balancer includes a balance weight which is moved vertically in a direction opposite from the vertical movement of a slider, thereby offsetting or canceling an unbalanced inertial force generated during the vertical movement of the slider to suppress vibration during operation of the pressing machine. The incorporation of the dynamic balancer thus realizes to conduct a press working at a high speed and with a high accuracy. One type of such pressing machine incorporating a dynamic balancer includes a slider and a balance weight connected to each other through a link mechanism. The pressing machine also includes a plate cam mounted on an input shaft for controlling movement of the slider and a plate cam mounted on the input shaft for controlling movement of the balance weight, so that the slider and the balance weight are controlled by the plate cams to reciprocally move in directions opposite from each other. Such pressing machine is disclosed in JP-A-9-66395, for example.

In each of the prior art machines disclosed in JP-Y2-5-22394 and JP-Y2-5-22395, the slider is mounted in the housing for vertical sliding movement and surrounds the cam, and the cam and the slider constitute a yoke cam mechanism. Such an arrangement suffers from a problem that the slider is increased in size, resulting in an inertial force increased during the operation. This is one cause obstructing an increase in operation speed of the pressing machine. Another problem resides in that it is difficult to incorporate in the pressing machine the dynamic balancer in such a manner as to make it function satisfactorily. Namely, when the yoke cam mechanism is employed, the single cam is interposed between the two cam followers provided on the slider and for this reason, it is difficult to arrange the dynamic balancer at a location symmetric with the slider with respect to the cam.

In the prior art machine disclosed in JP-A-9-66395, the plate cams for controlling sliding movement of the slider and the plate cam for controlling sliding movement of the balance weight are provided separately from each other, and the link mechanism is used. This suffers from a problem that many elements are required to drive the slider and the dynamic balancer, resulting in an increase in size of the pressing machine. There is also a problem that the degree of freedom for designing the cam shape is limited, since the cams and the cam followers have to be preferably contacted with each other even under the presence of the link mechanism.

SUMMARY OF THE INVENTION

Accordingly, it is an object of the present invention to provide a mechanical pressing machine, wherein the problems associated with the prior arts are overcome, and the dynamic balancer can be allowed to function satisfactorily without causing an increase in size of the slider, thereby realizing the operation at a high speed and with a high accuracy.

To achieve the above object, according to the present invention, there is provided a mechanical pressing machine, comprising an input shaft rotatably mounted to a housing, a cam mounted concentrically on the input shaft and having a cam surface with a plurality of projections, said cam surface being symmetric with respect to the input shaft and the number of the projections being equal to 2n when n is a natural number, a slider supported by the housing for reciprocal sliding movement in a direction transverse to the input shaft, a first cam follower rotatably carried on the slider to abut against the cam, slider-preloading means for biasing the slider toward the cam to maintain an abutment of the first cam follower against the cam, and a dynamic balancer, the dynamic balancer including a sliding block which is carried in the housing for reciprocal sliding movement in a direction transverse to the input shaft, the sliding block being arranged at a location opposite from the slider with respect to the cam, a second cam follower rotatably carried on the sliding block to abut against the cam at a location opposite from the first cam follower with respect to the cam, a balance weight connected to the sliding block for movement in unison with the sliding block, and sliding block-preloading means for biasing the sliding block toward the cam to maintain an abutment of the second cam follower against the cam.

It is preferable that the slider-preloading means includes a plurality of connecting rods extending from the slider toward the dynamic balancer, and a spring member for biasing the slider toward the cam through the connecting rods. It is also preferable that the sliding block-preloading means includes a spring member mounted between a wall of the housing and the sliding block for biasing the sliding block toward the cam.

In one embodiment of the present invention, the input shaft extends horizontally, the slider is supported by the housing for vertical sliding movement at a location below the cam, the first cam follower abuts against a lower surface of the cam, the sliding block is carried in the housing for vertical sliding movement at a location above the cam, the second cam follower abuts against an upper surface of the cam, and the balance weight is located above the sliding block.

The mechanical pressing machine provides the following advantages:

(1) The slider and the dynamic balancer are driven by the same cam and hence, the arrangement is compact.

(2) The slider is not increased in size as compared with the above-described prior art using the yoke cam mechanism, and a smaller number of members or elements are mounted around the slider. Thus, the degree of freedom for designing the slider and a slider guide for guiding the sliding movement of the slider is higher, and the slider guide can be formed in a larger size, whereby the slider can be moved with a high accuracy.

(3) The dynamic balancer can be allowed to function in a position symmetric with the slider with respect to the cam mounted on the input shaft. Thus, it is possible to effectively prevent the generation of vibration and a noise, and to reduce occurrence of the deflection of the entire pressing machine to enhance the dynamic accuracy.

(4) The pressing machine is of such construction that the slider is driven directly by the cam through the first cam follower carried on the slider, and hence the high accuracy in operation may be realized.

(5) The cam has a cam surface symmetric with respect to the input shaft and having the projections, and the number of the projections is equal to 2n when n is a natural number. Thus, the slider can be reciprocally moved a large number of times per rotation of the input shaft, for example, by setting n at a natural number equal to or larger than 2. Thus, the number of rotations of the input shaft for reciprocally moving the slider a predetermined number of times is decreased and hence, the vibration can be suppressed to decrease the generation of heat.

(6) As described above, the entire pressing machine can be constructed compactly. Therefore, the pressing machine need not necessarily be used in an attitude or state in which the slider assumes a lower position. The machine can be used in an attitude or state in which it has been turned upside down, so that the slider assumes an upper position, or it has been turned sideways or inclined.

(7) The pressing machine can be used in the attitude as in the above item (6) and hence, can be also used as a nail-driving machine for driving a nail by utilizing the reciprocal movement of the slider, or the like. Therefore, "the pressing machine" according to the present invention is not limited to the machine for carrying out the pressing or press working such as bending, punching or the like.

The above and other objects, features and advantages of the invention will become apparent from the following description of the preferred embodiment taken in conjunction with the accompanying drawings.

DESCRIPTION OF THE PREFERRED EMBODIMENT

Figure 1:
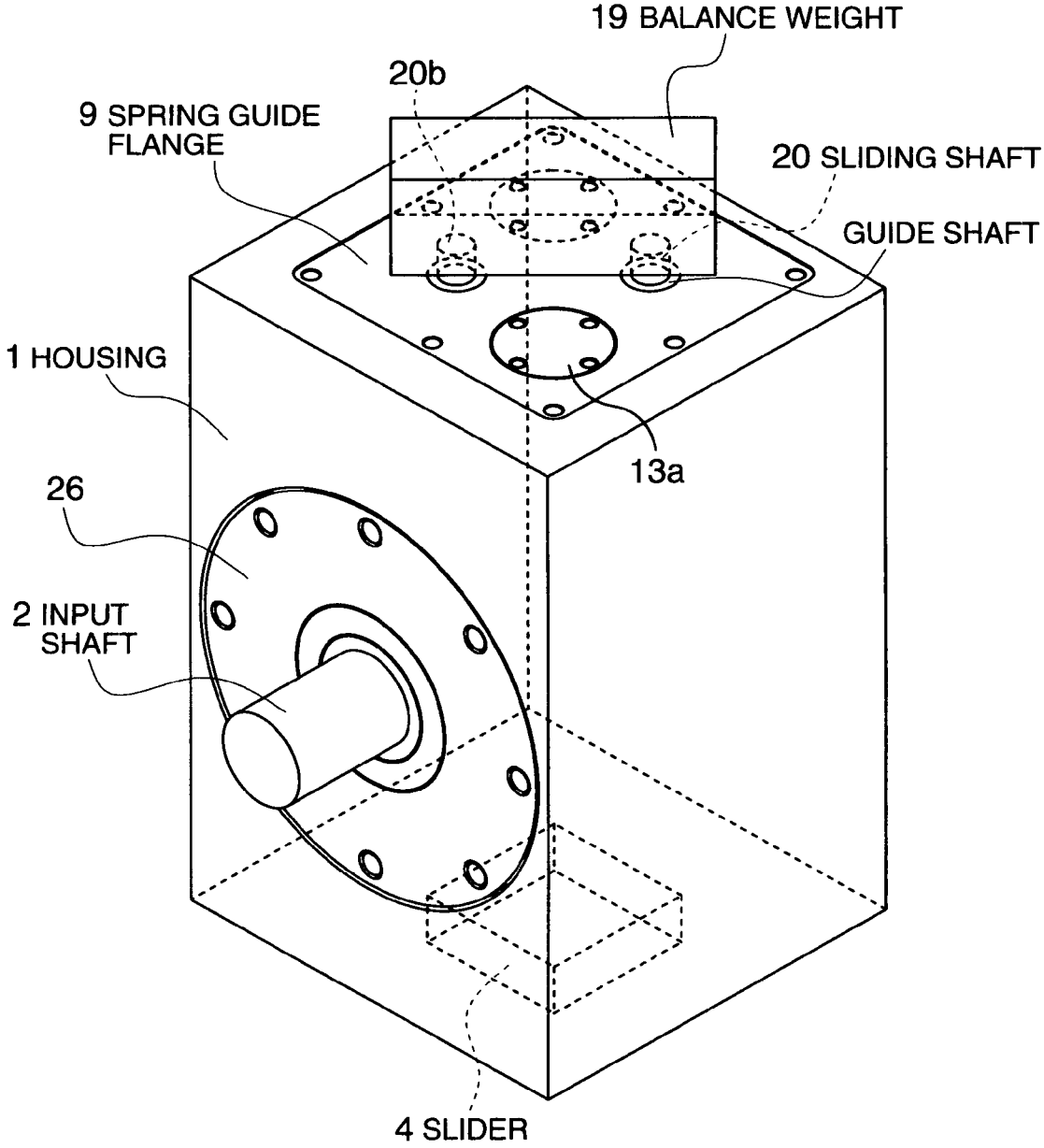
FIG. 1 is a perspective view of a mechanical pressing machine according to one embodiment of the present invention.
Figure 2:
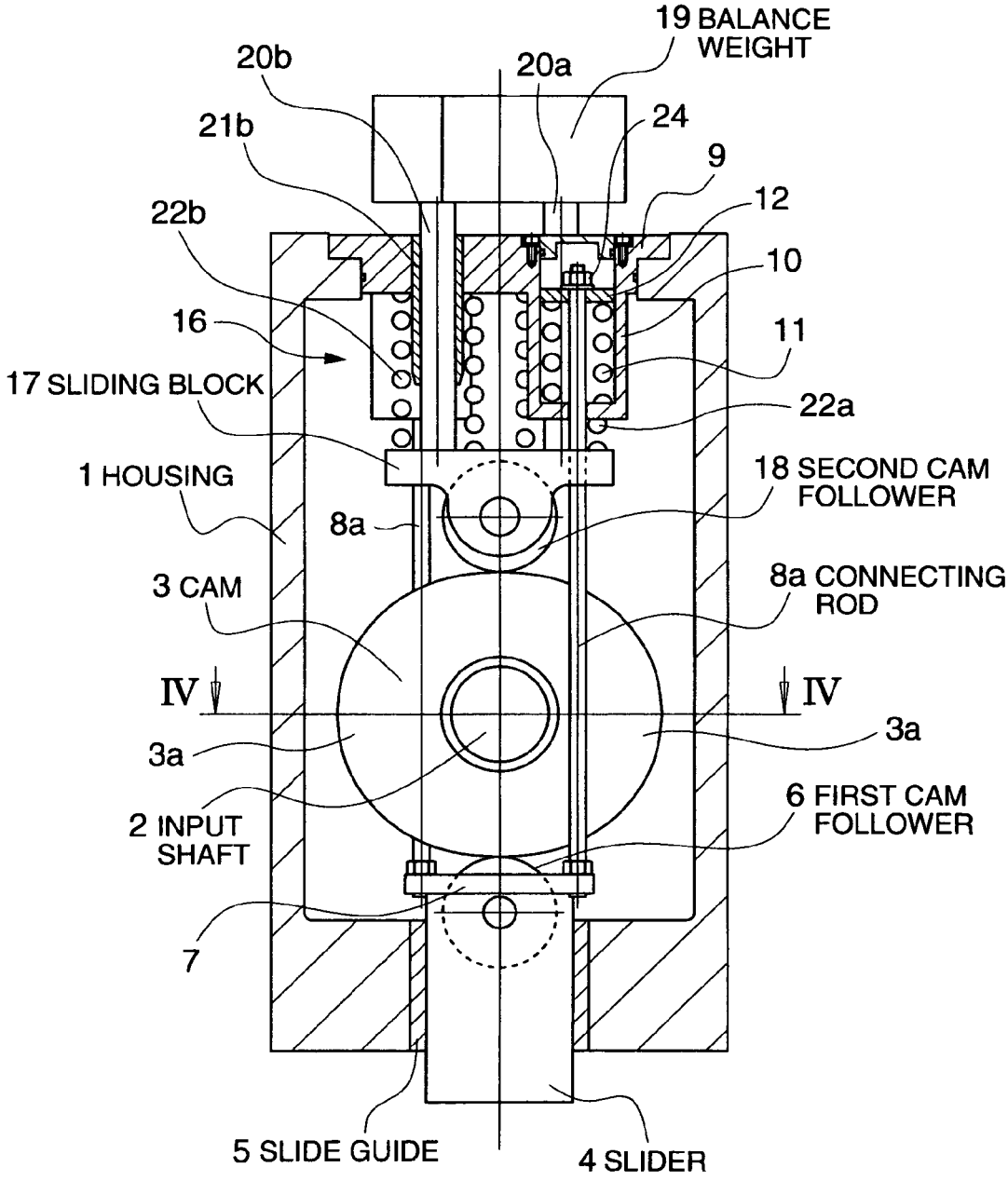
FIG. 2 is a sectional front view of the mechanical pressing machine.

A mechanical pressing machine according to an embodiment of the invention will now be described with reference to the accompanying drawings.

As shown in FIGS. 1 to 5, the mechanical pressing machine according to this embodiment includes an input shaft 2 rotatably mounted to a housing 1 through bearings 23*a* and 23*b*, a cam 3 mounted concentrically on the input shaft 2, a slider 4 located below the cam 3 and supported by a lower wall of the housing 1 through a slide guide 5 for vertical sliding movement, and a dynamic balancer 16 which will be described in detail hereinafter. The cam 3 has a cam surface which has two projections 3*a* and which is symmetric with respect to the input shaft 2. The number of the projections 3*a* is not limited to two and it may be 2n (n being a natural number). The slider 4 rotatably carries a first cam follower 6. A pressing die which is not shown is fixed to a lower end of the slider 4. In the figures, reference numeral 25 designates a seal member, and reference numeral 26 designates an input shaft flange.

Figure 3:
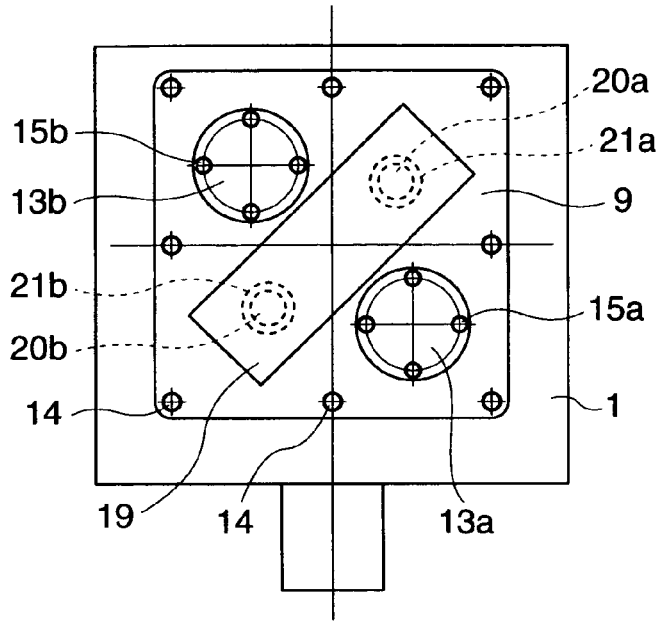
FIG. 3 is a top view of the mechanical pressing machine.
Figure 4:
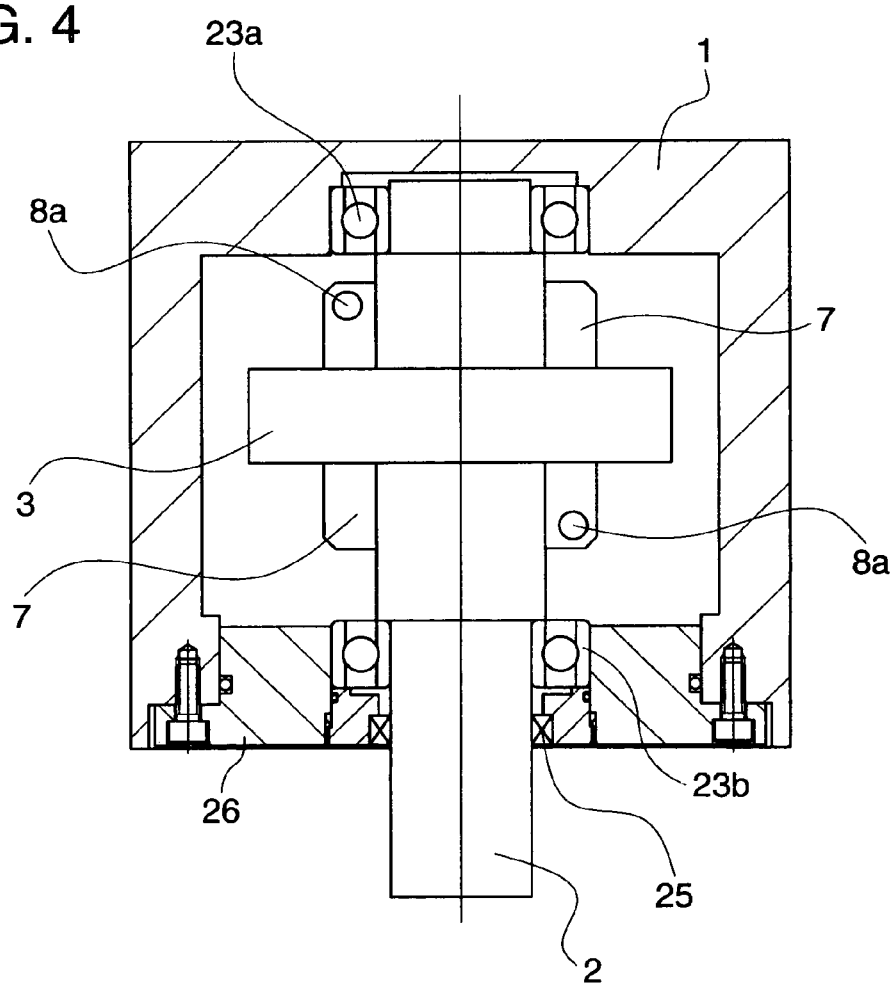
FIG. 4 is a sectional view taken along a line IV—IV in FIG. 2.
Figure 5:
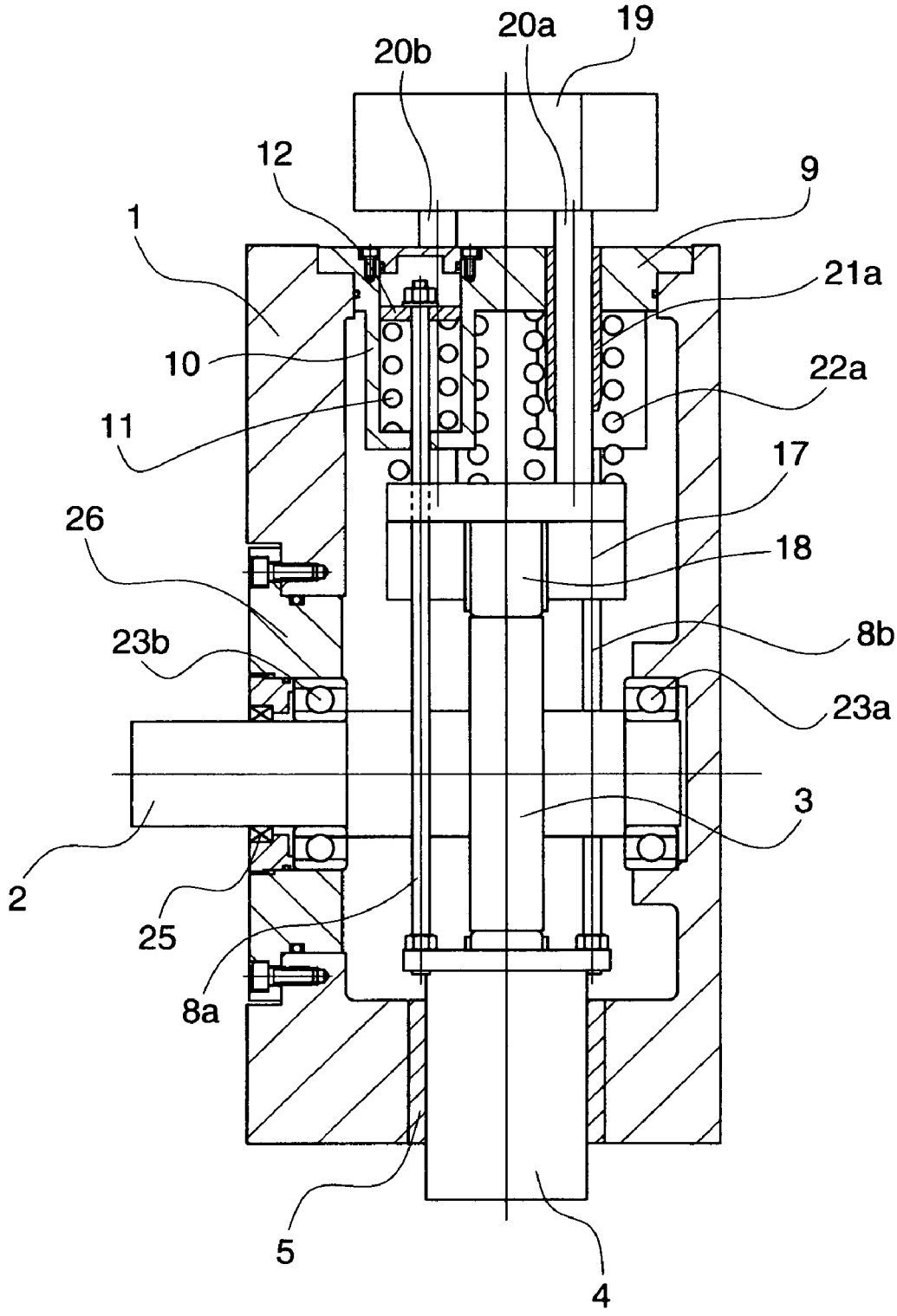
FIG. 5 is a sectional side view of the mechanical pressing machine.

A spring guide flange 9 is mounted at an upper wall of the housing 1 and fixed thereto by bolts 14. The spring guide flange 9 constitutes a part of the upper wall of the housing 1. As shown in FIG. 3, the spring guide flange 9 is rectangular as viewed from above, and a spring case 10 is mounted in a hanging manner in each of two regions on a diagonal line of the rectangular shape, i.e., in a left and upper region and a right and lower region in FIG. 3. Lid members 13*a* and 13*b* are mounted at upper ends of the spring cases 10 and fixed by bolts 15*a* and 15*b*, respectively.

The slider 4 includes a rod-fastening member 7 at its upper end. The rod-fastening member 7 is rectangular in shape as viewed from above, and connecting rods 8*a* and 8*b* extend from two corner portions of the rod-fastening member 7 located on a diagonal line of the rectangular shape upwards toward the dynamic balancer 16 which will be described in detail hereinafter. Upper portions of the connecting rods 8*a* and 8*b* extend through the respective spring cases 10. Spring members 11 each including a coil spring are accommodated in the spring cases 10 and surround the respective connecting rods 8*a* and 8*b*. A spring-retaining plate 12 is fitted on an upper portion of each of the connecting rods 8*a* and 8*b* and engages an upper end of each of the spring members 11. Each of the spring members 11 is maintained in a compressed state between a bottom wall of each of the spring cases 10 and each of the spring-retaining plates 12 by tightening in a suitable amount a nut 24 threadedly engaged with each of the connecting rods 8*a* and 8*b*. Therefore, the spring members 11 bias the connecting rods 8*a* and 8*b* upwards through the spring-retaining plates 12 and also bias the slider 4 upwards through the connecting rods 8*a* and 8*b*.

As can be seen from the forgoing, the connecting rods 8*a* and 8*b*, the spring members 11, the spring-retaining plates 12 and the like constitute a slider-preloading means for biasing the slider 4 toward the cam 3 to maintain the abutment of the first cam follower 6 against the cam 3.

The dynamic balancer 16 includes a sliding block 17 located above the cam 3, a balance weight 19 located above the sliding block 17, and a second cam follower 18 rotatably carried by the sliding block 17 to abut against an upper surface of the cam 3. The sliding block 17 has sliding shafts 20*a* and 20*b* which are vertically slidably fitted in hollow guide shafts 21*a* and 21*b* mounted to the spring guide flange 9. The balance weight 19 is fixed to upper ends of the sliding shafts 20*a* and 20*b* at locations outside and above the housing 1. Therefore, the sliding block 7 and the balance weight 19 are capable of being vertically moved in unison with each other.

As can be seen from FIG. 3, the balance weight 19 extends in a rectangular shape over two regions on the diagonal line of the spring guide flange 9, i.e., in a right and upper region and a left and lower region in FIG. 3. These regions are those where the spring cases 10 and the lid members 13*a* and 13*b* are not present.

Spring members 22*a* and 22*b* each including a coil spring are mounted between a lower surface of the spring guide flange 9 and an upper surface of the sliding block 17 to surround the sliding shafts 20*a* and 20*b*, respectively, and are maintained in compressed states. The spring members 22*a* and 22*b* and the like constitute a sliding block-preloading means for biasing the sliding block 17 toward the cam 3 to maintain the abutment of the second cam follower 18 against the cam 3.

In the illustrated embodiment, the spring members 11 for exerting a pre-load to the slider 7, the spring members 22*a* and 22*b* for exerting a pre-load to the sliding block 17 and members associated with these spring members are mounted in an upper portion of the housing 1. The arrangement, in which the spring members 11, 22*a* and 22*b* and the like are mounted in a collected manner at one place, as described above, brings about an advantage that the assembling, the adjustment and the like are facilitated.

Figure 6:
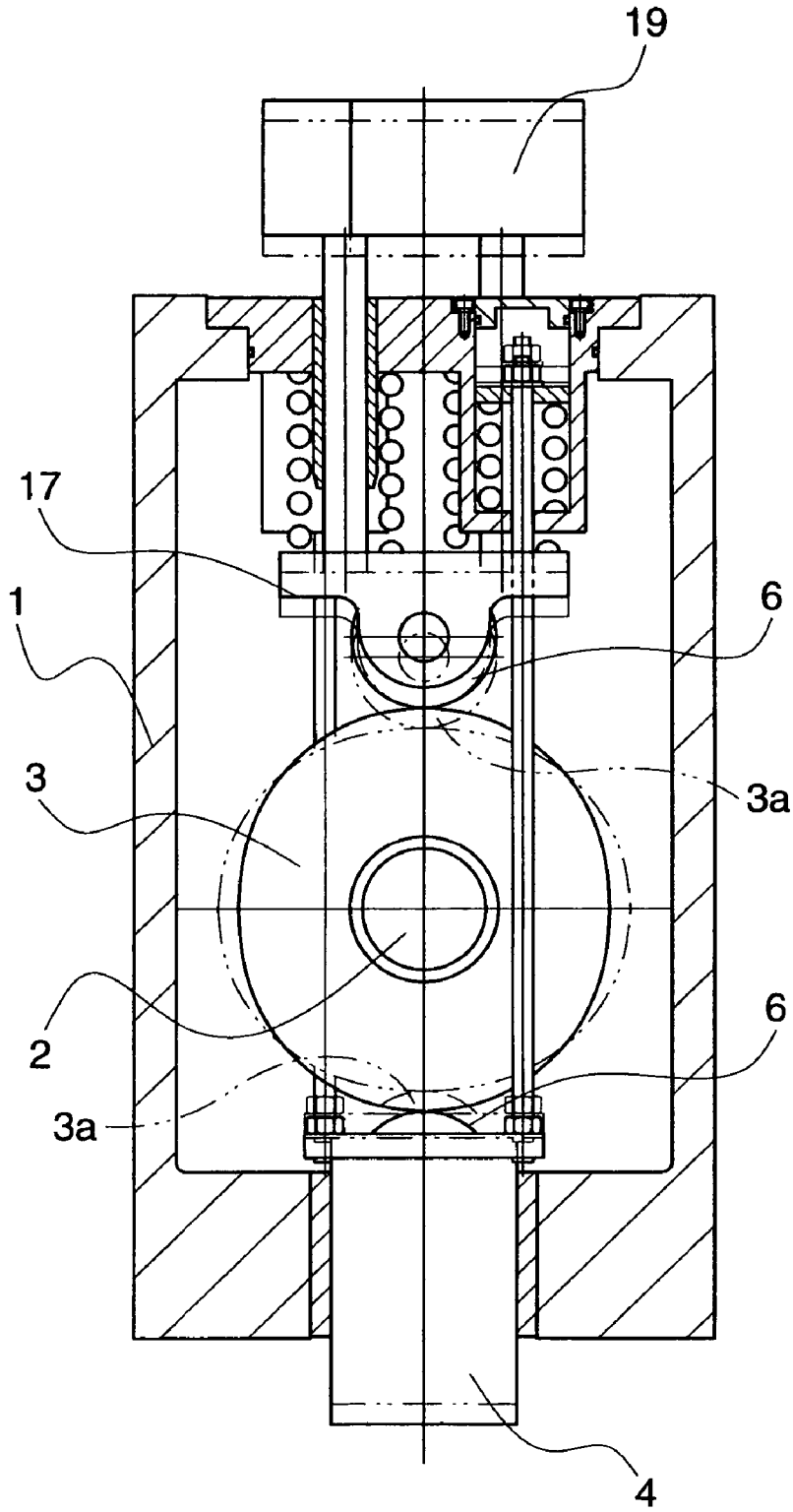
FIG. 6 is a sectional front view similar to FIG. 2, but showing the operative state of the mechanical pressing machine.

The mechanical pressing machine according to the illustrated embodiment is of the above-described construction, and when the cam 3 is in a position indicated by a dashed line in FIG. 6, the slider 4 is in a top dead center position. When the cam 3 is rotated from this state in unison with the input shaft 2, the slider 4 is gradually lowered. When the first cam follower 6 reaches a position indicated by a solid line in FIG. 6 in which it is in engagement with the projection 3*a* of the cam 3, the slider 4 reaches a bottom dead center position to conduct press working. Thus, by continuously driving and rotating the input shaft 2 and the cam 3 integral with the input shaft 2, the slider 4 repeatedly effects reciprocal vertical movements to conduct press workings. The number of times or frequency of such reciprocal movements repeated by the slider 4 corresponds to the number of the projections 3*a* of the cam 3.

When the cam 3 is in the position indicated by the dashed line in FIG. 6, the sliding block 17 and the balance weight 19 are in bottom dead center positions. When the input shaft 2 is rotated from this state, the sliding block 17 and the balance weight 19 are gradually raised. When the second cam follower 6 reaches the position indicated by the solid lines in FIG. 6 in which it is in engagement with the projection 3*a* of the cam 3, the sliding block 17 and the balance weight 19 reach the top dead center positions. In this way, while the slider 4 is being moved vertically, the block 17 and the balance weight 19 are being moved vertically in the direction opposite from that of the movement of the slider 4. Thus, an unbalanced inertial force generated during the reciprocal movements of the slider 4 is offset or cancelled.

Although the preferred embodiment of the present invention has been described in detail, it will be understood that the invention is not limited to such embodiment, and various modifications in design may be made without departing from the spirit and scope of the invention defined in the claims.

What is claimed is:

1. A mechanical pressing machine, comprising an input shaft rotatably mounted to a housing, a cam mounted concentrically on said input shaft and having a cam surface with a plurality of projections, said cam surface being symmetric with respect to said input shaft and the number of said projections being equal to 2n when n is a natural number, a slider supported by the housing for reciprocal sliding movement in a direction transverse to said input shaft, a first cam follower rotatably carried on said slider to abut against said cam, slider-preloading means for biasing said slider toward said cam to maintain an abutment of said first cam follower against said cam, and a dynamic balancer, said dynamic balancer including a sliding block carried in said housing for reciprocal sliding movement in a direction transverse to said input shaft, said sliding block being arranged at a location opposite from said slider with respect to said cam, a second cam follower rotatably carried on said sliding block to abut against the cam at a location opposite from said first cam follower with respect to said cam, a balance weight connected to said sliding block for movement in unison with said sliding block, and sliding block-preloading means for biasing said sliding block toward said cam to maintain an abutment of said second cam follower against said cam.

2. A mechanical pressing machine according to claim 1, wherein said slider-preloading means includes a plurality of connecting rods extending from said slider toward said dynamic balancer, and a spring member for biasing said slider toward said cam through said connecting rods.

3. A mechanical pressing machine according to claim 1, wherein said sliding block-preloading means includes a spring member mounted between a wall of said housing and said sliding block for biasing said sliding block toward said cam.

4. A mechanical pressing machine according to claim 2, wherein said sliding block-preloading means includes a spring member mounted between a wall of said housing and said sliding block for biasing said sliding block toward said cam.

5. A mechanical pressing machine according to claim 1, wherein said input shaft extends horizontally, said slider is supported by said housing for vertical sliding movement at a location below said cam, said first cam follower abuts against a lower surface of said cam, said sliding block is carried in said housing for vertical sliding movement at a location above said cam, said second cam follower abuts against an upper surface of said cam, and said balance weight is located above said sliding block.

6. A mechanical pressing machine according to claim 5, wherein said slider-preloading means includes a plurality of connecting rods extending upwards from said slider, and a spring member mounted in an upper portion of said housing for biasing the connecting rods upwards.

7. A mechanical pressing machine according to claim 5, wherein said sliding block-preloading means includes a spring member mounted between an upper wall of said housing and said sliding block for biasing said sliding block downwards.

8. A mechanical pressing machine according to claim 6, wherein said sliding block-preloading means includes a spring member mounted between an upper wall of said housing and said sliding block for biasing said sliding block downwards.

* * * * *